US011001935B2

(12) United States Patent
Timpano et al.

(10) Patent No.: US 11,001,935 B2
(45) **Date of Patent: *May 11, 2021**

(54) ANODE FOR OXYGEN EVOLUTION

(75) Inventors: Fabio Timpano, Desio (IT); Alice Calderara, Agnadello (IT)

(73) Assignee: INDUSTRIE DE NORA S.P.A., Milan (IT)

( * ) Notice: Subject to any disclaimer, the term of this patent is extended or adjusted under 35 U.S.C. 154(b) by 0 days.

This patent is subject to a terminal disclaimer.

(21) Appl. No.: 14/116,882

(22) PCT Filed: Jun. 22, 2012

(86) PCT No.: PCT/EP2012/062088

§ 371 (c)(1),
(2), (4) Date: Dec. 10, 2013

(87) PCT Pub. No.: WO2012/175673

PCT Pub. Date: Dec. 27, 2012

(65) Prior Publication Data

US 2014/0311915 A1 Oct. 23, 2014

(30) Foreign Application Priority Data

Jun. 22, 2011 (IT) ..... MI2011A001132

(51) Int. Cl.

| | |
|---|---|
| ***C25D 17/10*** | (2006.01) |
| ***C25C 7/02*** | (2006.01) |
| ***C25B 11/093*** | (2021.01) |
| ***C25D 3/02*** | (2006.01) |

(52) U.S. Cl.

CPC ..... *C25D 17/10* (2013.01); *C25B 11/093* (2021.01); *C25C 7/02* (2013.01); *C25D 3/02* (2013.01)

(58) Field of Classification Search

CPC .... C25B 11/00–0494; C25D 17/10–14; C25C 7/02–025; B01J 23/46; B01J 23/248; B01J 23/14; B01J 23/16

USPC .... 204/280, 290.01, 290.12, 290.14, 290.03, 204/290.08, 290.09, 292, 293

See application file for complete search history.

(56) References Cited

U.S. PATENT DOCUMENTS

| | | | | |
|---|---|---|---|---|
| 6,103,093 | A * | 8/2000 | Nidola | C25B 11/0484 204/290.13 |
| 2008/0116064 | A1 | 5/2008 | Hashimato | |
| 2008/0149476 | A1* | 6/2008 | Hashimoto | C25B 11/0478 204/290.12 |

FOREIGN PATENT DOCUMENTS

| | | |
|---|---|---|
| GB | 2291887 | 2/1996 |
| WO | 03/100135 | 12/2003 |
| WO | WO 2010055065 A1 * | 5/2010 |

OTHER PUBLICATIONS

Chen et al (Journal of Physical Chemistry B, 105, 2001, pp. 4623-4628).*
Marshall et al (Electrochemica Actam 51, 2006, pp. 3161-3167).*
Hu et al (Electrochemical and Solid-State Letters, 13, 9, 2010, p. F20-F23).*
Sardar et al ("Bismuth Iridium Oxide Oxygen Evolution Catalyst from Hydrothermal Synthesis", Chemistry of Materials, Oct. 2012, 24 (21), pp. 4192-4200).*
International Search Report issued in counterpart PCT Application No. PCT/EP2012/062088.

* cited by examiner

*Primary Examiner* — Alexander W Keeling
(74) *Attorney, Agent, or Firm* — Lucas & Mercanti, LLP

(57) ABSTRACT

An electrode for electrochemical processes comprises a substrate of titanium or other valve metal, an intermediate protection layer based on valve metal oxides and a catalytic layer based on oxides of tin and of iridium doped with small amounts of oxides of elements selected between bismuth, antimony, tantalum and niobium. The electrode used in electrometallurgical processes, for example in the electrowinning of metals, as anode for anodic oxygen evolution presents a reduced overvoltage and a higher duration.

6 Claims, No Drawings

ANODE FOR OXYGEN EVOLUTION

This application is a U.S. national stage of PCT/EP2012/062088 filed on Jun. 22, 2012 which claims the benefit of priority from Italian Patent Application No. MI2011A001132 filed Jun. 22, 2011, the contents of each of which are incorporated herein by reference.

FIELD OF THE INVENTION

The invention relates to an electrode for electrolytic processes, in particular to an anode suitable for oxygen evolution in an industrial electrolytic process and to a method of manufacturing thereof.

BACKGROUND OF THE INVENTION

The invention relates to an electrode for electrolytic processes, in particular to an anode suitable for oxygen evolution in an industrial electrolytic process. Anodes for oxygen evolution are widely used in various electrolysis applications, several of which fall in the domain of cathodic metal electrodeposition (electrometallurgy) and cover a wide range in terms of applied current density, which can be very reduced (for instance few hundreds $A/m^2$, such as in metal electrowinning processes) or very high (such as in some applications of galvanic electrodeposition, in which 10 $kA/m^2$ may be exceeded, referred to the anodic surface); another field of application of anodes for oxygen evolution is given by impressed current cathodic protection. In the electrometallurgical field, with particular reference to metal electrowinning, the use of lead-based anodes is traditionally widespread and still suitable for some applications although presenting a rather high oxygen evolution overpotential besides entailing the known hazard for environment and human health associated to the utilisation of such material. More recently, especially for high current density applications which take a higher advantage of energy savings associated with a decreased oxygen evolution potential, oxygen-evolving electrodes obtained starting from substrates of valve metals, for instance titanium and alloys thereof, coated with catalytic compositions based on metals or oxides thereof were introduced to the market. A typical composition suitable for catalysing the oxygen evolution anodic reaction consists for example of a mixture of oxides of iridium and tantalum, wherein iridium constitutes the catalytically-active species and tantalum favours the formation of a compact coating, capable of protecting the valve metal substrate from corrosion phenomena especially when operating with aggressive electrolytes.

An electrode with the specified composition is capable of withstanding the needs of several industrial applications, both at low and high current density, with reasonable operative lifetimes. The economy of some manufacturing processes, especially in the metallurgical field (for instance copper or tin electrowinning) nevertheless requires electrodes having a further enhanced catalytic activity, in other word a further reduced oxygen evolution potential, in order to make their cost competitive versus the traditional cheaper-to-manufacture lead electrodes, while retaining a very high operative lifetime.

A particularly active catalytic coating for oxygen evolution is obtainable starting from a mixture of oxides of tin and of iridium, deposited on a valve metal substrate by thermal decomposition of precursors at a sufficiently reduced temperature (for instance not higher than 450° C. versus the 480-530° C. required for obtaining the deposition by thermal decomposition of iridium and tantalum oxide precursors with the same method). This type of coating however presents an insufficient operative lifetime with respect to the needs of common electrometallurgical applications.

It must also be considered that the operative lifetime of anodes based on metal or metal oxides on valve metal substrates is greatly reduced in the presence of particularly aggressive contaminants, capable of establishing accelerated phenomena of corrosion or of anode surface fouling. An example of the former kind is given by fluoride ions, which determine a specific attack on valve metals such as titanium, deactivating electrodes in very fast times; in some industrial environments, remarkable costs are borne to diminish fluoride concentration down to extremely low levels, since a fluoride ion content higher than 0.2 parts per million (ppm) could already be liable to show sensible effects on the duration of anodes. An example of the latter kind is given on the other hand by manganese ions—present in a number of industrial electrolytes in typical amounts of 2-30 g/l—which starting from concentrations as low as 1 g/l have the tendency to film the anodic surface with an $MnO_2$ layer capable of shielding the catalytic activity thereof and difficult to remove without inducing damages.

Anodes obtained starting from substrates of valve metals such as titanium and alloys thereof coated with mixtures of oxides of iridium and tantalum or of iridium and tin normally present a limited tolerance to the presence of manganese or fluoride ions.

It has thus been evidenced the need for oxygen-evolving anodes characterised by a very reduced oxygen overpotential coupled with operative lifetimes equivalent or higher than those of the electrodes of the prior art even at particularly critical process conditions, such as a high current density or the presence of particularly aggressive electrolytes, for instance due to the presence of contaminant species.

DESCRIPTION OF THE INVENTION

Various aspects of the invention are set out in the accompanying claims.

Under one aspect, an electrode suitable for oxygen evolution in electrolytic processes comprises a valve metal substrate and an external catalytic layer with a protective layer consisting of valve metal oxides interposed in-between, wherein the catalytic layer comprises a mixture of oxides of iridium, of tin and of at least one doping element M selected from the group consisting of bismuth, antimony, tantalum and niobium, in which the molar concentration of iridium ranges from 25 to 55% with respect to the sum of iridium and tin and the molar concentration of dopant M ranges from 2 to 15% of the overall metal content, expressed as sum of iridium, tin and doping element M itself. The inventors in fact surprisingly observed that mixed oxides of tin and iridium at the specified composition present a very high catalytic activity for the oxygen evolution reaction versus a lifetime at least equivalent to that of the best electrodes of the prior art and a remarkably increased tolerance toward manganese ions and fluoride ions. Without wishing to limit the present invention to any particular theory, the inventors observe that the preparation of electrodes at the specified composition by thermal decomposition of precursor salts tends to form surprisingly small crystals—commonly associated to a high catalytic activity—for instance crystallites having an average size below 5 nm, even at high decomposition temperature, for instance 480° C. or higher, normally considered necessary for imparting a sufficient operative duration. In one embodiment, the doping element M is selected between bismuth and antimony and its molar concentration ranges between 5 and 12% of the overall metal content, expressed as sum of iridium, tin and doping element M. This has the advantage of allowing the formation of crystallites of average size below 4 nm even in case of decomposition of precursor solutions in the temperature range comprised between 480 and 530° C., more than sufficient to impart an excellent stability to the catalyst. In one embodiment, the molar concentration of iridium in the catalytic layer ranges between 40 and 50% with respect to the sum of iridium and tin; the inventors found out that in this composition range, the effect of the doping element is particularly effective in allowing the formation of crystallites of reduced size and high catalytic activity.

In one embodiment, the protective layer interposed between catalytic layer and valve metal substrate comprises a valve metal oxide capable of forming a thin film impervious to electrolytes, for instance selected between titanium oxide, tantalum oxide or mixtures of the two. This has the advantage of further protecting the underlying substrate based on titanium or other valve metal from the attack of aggressive electrolytes, for instance in processes such as those typical of metal electrodeposition.

In one embodiment, the electrode is obtained on an optionally alloyed titanium substrate; compared to other valve metals, titanium is characterised by a reduced cost coupled with a good corrosion resistance. Furthermore, titanium presents a good machinability, which allows its use for obtaining substrates of various geometry, for instance in form of planar sheet, punched sheet, expanded sheet or mesh, according to the needs of the different applications.

Under another aspect, the invention relates to a method for manufacturing an electrode suitable for use as oxygen-evolving anode in electrolytic processes, comprising a step of application in one or more coats of a solution containing precursors of iridium, tin and at least one doping element M selected from the group consisting of bismuth, antimony, tantalum and niobium, with subsequent decomposition by thermal treatment in air at a temperature of 480 to 530° C. Before said application step, the substrate may be provided with a protective layer based on valve metal oxides applied by procedures known in the art, for instance by flame or plasma spraying, by protracted thermal treatment of the substrate in an air atmosphere, by thermal decomposition of a solution containing compounds of valve metals such as titanium or tantalum or else.

Under another aspect, the invention relates to a process of cathodic electrodeposition of metals starting from an aqueous solution wherein the anodic half-reaction is an oxygen evolution reaction carried out on the surface of an electrode as hereinbefore described.

Some of the most significant results obtained by the inventors are presented in the following examples, which are not intended as a limitation of the extent of the invention.

EXAMPLE 1

A titanium sheet grade 1 of 200×200×3 mm size was degreased with acetone in a ultrasonic bath for 10 minutes and subjected first to sandblasting with corundum grit until obtaining a value of superficial roughness $R_z$ of 40 to 45 μm, then to annealing for 2 hours at 570° C., then to an etching in 27% by weight $H_2SO_4$ at a temperature of 85° C. for 105 minutes, checking that the resulting weight loss was comprised between 180 and 250 g/m$^2$.

After drying, a protective layer based on titanium and tantalum oxides at a 80:20 weight ratio was applied to the sheet, with an overall loading of 0.6 g/m$^2$ referred to the metals (equivalent to 0.87 g/m$^2$ referred to the oxides). The application of the protective layer was carried out by painting in three coats of a precursor solution—obtained by addition of an aqueous $TaCl_5$ solution, acidified with HCl, to an aqueous solution of $TiCl_4$—and subsequent thermal decomposition at 515° C.

A 1.65 M solution of Sn hydroxyacetochloride complex (SnHAC in the following) was prepared according to the procedure disclosed in WO 2005/014885.

A 0.9 M solution of Ir hydroxyacetochloride complex (IrHAC in the following) was prepared by dissolving $IrCl_3$ in 10% vol. aqueous acetic acid, evaporating the solvent, adding 10% aqueous acetic acid with subsequent solvent evaporation twice more, finally dissolving the product in 10% aqueous acetic acid again to obtain the specified concentration.

A precursor solution containing 50 g/l of bismuth was prepared by cold dissolution of 7.54 g of $BiCl_3$ under stirring in a beaker containing 60 ml of 10% wt. HCl. Upon completion of the dissolution, once a clear solution was obtained, the volume was brought to 100 ml with 10% wt. HCl.

10.15 ml of the 1.65 M SnHAC solution, 10 ml of the 0.9 M IrHAC solution and 7.44 ml of the 50 g/l Bi solution were added to a second beaker kept under stirring. The stirring was protracted for 5 more minutes. 10 ml of 10% wt. acetic acid were then added.

The solution was applied by brushing in 7 coats to the previously treated titanium sheet, carrying out a drying step at 60° C. for 15 minutes after each coat and a subsequent decomposition at high temperature for 15 minutes. The high temperature decomposition step was carried out at 480° C. after the first coat, at 500° C. after the second coat, at 520° C. after the subsequent coats.

In this way, a catalytic layer having an Ir:Sn:Bi molar ratio of 33:61:6 and a specific Ir loading of about 10 g/m$^2$ was applied.

The electrode was identified with the tag "Ir33Sn61 Bi6".

EXAMPLE 2

A titanium sheet grade 1 of 200×200×3 mm size was pre-treated and provided with a protective layer based on titanium and tantalum oxides in an 80:20 molar ratio as in the previous example.

A precursor solution containing 50 g/l of antimony was prepared by dissolution of 9.4 g of $SbCl_3$ at 90° C. under stirring, in a beaker containing 20 ml of 37% wt. HCl. Upon completion of the dissolution, once a clear solution was obtained, 50 ml of 20% HCl were added and the solution was allowed to cool down to ambient temperature. The volume was then finally brought to 100 ml with 20% wt. HCl.

10.15 ml of the 1.65 M SnHAC solution of the previous example, 10 ml of the 0.9 M IrHAC solution of the previous example and 7.44 ml of the 50 g/l Sb solution were added to a second beaker kept under stirring. The stirring was protracted for 5 more minutes. 10 ml of 10% wt. acetic acid were then added.

The solution was applied by brushing in 8 coats to the previously treated titanium sheet, carrying out a drying step at 60° C. for 15 minutes after each coat and a subsequent decomposition at high temperature for 15 minutes. The high temperature decomposition step was carried out at 480° C.

after the first coat, at 500° C. after the second coat, at 520° C. after the subsequent coats.

In this way, a catalytic layer having an Ir:Sn:Sb molar ratio of 31:58:11 and a specific Ir loading of about 10 g/m$^2$ was applied.

The electrode was identified with the tag "Ir31Sn58Sb11".

COUNTER EXAMPLE 1

A titanium sheet grade 1 of 200×200×3 mm size was pre-treated and provided with a protective layer based on titanium and tantalum oxides in an 80:20 molar ratio as in the previous examples.

10.15 ml of the 1.65 M SnHAC solution of the previous examples and 10 ml of the 0.9 M IrHAC solution of the previous examples were added to a beaker kept under stirring.

The solution was applied by brushing in 8 coats to the previously treated titanium sheet, carrying out a drying step at 60° C. for 15 minutes after each coat and a subsequent decomposition at high temperature for 15 minutes. The high temperature decomposition step was carried out at 480° C. after the first coat, at 500° C. after the second coat, at 520° C. after the subsequent coats.

In this way, a catalytic layer having an Ir:Sn molar ratio of 35:65 and a specific Ir loading of about 10 g/m$^2$ was applied.

The electrode was identified with the tag "Ir35Sn65".

COUNTER EXAMPLE 2

A titanium sheet grade 1 of 200×200×3 mm size was pre-treated and provided with a protective layer based on titanium and tantalum oxides in an 80:20 molar ratio as in the previous examples. 10.15 ml of 1.65 M SnHAC solution and 10 ml of 0.9 M IrHAC solution were added to a beaker kept under stirring as in the previous example.

The solution was applied by brushing in 8 coats to the previously treated titanium sheet, carrying out a drying step at 60° C. for 15 minutes after each coat and a subsequent decomposition at 480° C. for 15 minutes.

In this way, a catalytic layer having an Ir:Sn molar ratio of 35:65 and a specific Ir loading of about 10 g/m$^2$ was applied.

The electrode was identified with the tag "Ir35Sn65 LT".

EXAMPLE 3

Coupons of 20 mm×60 mm size were obtained from the electrodes of the preceding examples and counterexamples and subjected to anodic potential determination under oxygen evolution, measured by means of a Luggin capillary and a platinum probe as known in the art, in a 150 g/l $H_2SO_4$ aqueous solution at a temperature of 50° C. The data reported in table 1 (SEP) represent the values of potential difference at a current density of 300 A/m$^2$ with respect to a PbAg reference electrode. Table 1 moreover reports the crystallite average size detected via X-ray diffraction (XRD) technique and the lifetime observed in an accelerated life test in a 150 g/l $H_2SO_4$ aqueous solution, at a current density of 60 A/m$^2$ and at a temperature of 50° C.

The results of these tests demonstrate how the addition of doping amounts of bismuth or antimony to a tin and iridium oxide-based coating allows combining an excellent oxygen evolution potential, typical of tin/iridium based formulations obtained at reduced decomposition temperature, with the optimal duration shown by tin/iridium oxide-based formulations obtained at high decomposition temperature.

The tests were repeated, obtaining equivalent results, varying the amount of bismuth and antimony in the molar range 2-15% referred to the metals: the best results were observed, both for bismuth and for antimony or for a combination of the two, in the molar range 5-12% referred to the metals.

Almost equivalent results were obtained by addition of amounts of niobium or tantalum in the same concentration ranges.

TABLE 1

| Electrode | Average crystallite size (nm) | SEP (mV vs. PbAg) @300 A/m$^2$ | Deactivation time in 150 g/l $H_2SO_4$ @60 kA/m$^2$, 50° C. |
|---|---|---|---|
| Ir33Sn61Bi6 | 3.5 | −460 | 900 |
| Ir31Sn58Sb11 | 3.7 | −440 | 870 |
| Ir35Sn65 | 5.9 | −405 | 880 |
| Ir35Sn65 LT | 4.1 | −430 | 340 |

EXAMPLE 4

The accelerated duration test of the previous table was repeated at the same conditions on equivalent coupons obtained from the same electrodes, upon addition of potassium fluoride (1 mg/l or 5 mg/l di $F^-$) or of $MnCl_2$ (20 g/l of $Mn^{++}$), giving the results reported in table 2, indicating a tolerance higher than expected for the electrode samples in accordance with the invention.

TABLE 2

| Electrode | Deactivation time in 150 g/l $H_2SO_4$ + 1 mg/l $F^-$ | Deactivation time in 150 g/l $H_2SO_4$ + 5 mg/l $F^-$ | Deactivation time in 150 g/l $H_2SO_4$ + 20 g/l $Mn^{++}$ |
|---|---|---|---|
| Ir33Sn61Bi6 | 730 | 370 | 860 |
| Ir31Sn58Sb11 | 645 | 350 | 860 |
| Ir35Sn65 | 650 | 360 | 850 |
| Ir35Sn65 LT | 265 | 105 | 310 |

The previous description shall not be intended as limiting the invention, which may be used according to different embodiments without departing from the scopes thereof, and whose extent is solely defined by the appended claims.

Throughout the description and claims of the present application, the term "comprise" and variations thereof such as "comprising" and "comprises" are not intended to exclude the presence of other elements, components or additional process steps.

We claim:

1. Electrode suitable for oxygen evolution in electrolytic processes comprising a valve metal substrate, an external catalytic layer and a protective layer consisting of valve metal oxides interposed between the substrate and the catalytic layer, wherein said valve metal oxides of said protective layer consists of titanium and tantalum oxides in an 80:20 molar ratio;

said catalytic layer comprises mixed oxides of iridium, of tin and of a doping element M, wherein M is bismuth, said catalytic layer obtained by applying a solution containing precursors of iridium, tin and said doping element M to the valve metal substrate and subsequently decomposing said solution by a thermal treatment in air at a temperature of 480 to 530° C. to obtain an average crystallite size of said mixed oxides lower than 5 nm;

the molar ratio Ir:(Ir+Sn) ranges from 0.25 to 0.55; and the molar ratio M:(Ir+Sn+M) ranges from 0.02 to 0.15.

2. The electrode according to claim 1 wherein said molar ratio M:(Ir+Sn+M) ranges from 0.05 to 0.12.

3. The electrode according to claim 1 wherein said molar ratio Ir:(Ir+Sn) ranges from 0.40 to 0.50.

4. The electrode according to claim 1 wherein the average crystallite size of said mixed oxides is lower than 4 nm.

5. The electrode according to claim 1 wherein said valve metal substrate is a solid, punched or expanded sheet or a mesh of titanium or titanium alloy.

6. Process of cathodic electrodeposition of metals from an aqueous solution comprising causing anodic evolution of oxygen on the surface of an electrode according to claim 1.

* * * * *